US010381181B2

(12) United States Patent
Vigouroux et al.

(10) Patent No.: US 10,381,181 B2
(45) Date of Patent: Aug. 13, 2019

(54) MOBILE PART OF AN ELECTROMAGNETIC ACTUATOR FOR AN ELECTRIC CONTACTOR, ACTUATOR COMPRISING SUCH A PART AND CONTACTOR

(71) Applicant: Schneider Electric Industries SAS, Rueil Malmaison (FR)

(72) Inventors: Didier Vigouroux, Brignoud (FR); Vincent Geffroy, Faramans (FR); Julien Henri-Rousseau, Grenoble (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 61 days.

(21) Appl. No.: 15/664,111

(22) Filed: Jul. 31, 2017

(65) Prior Publication Data

US 2018/0040446 A1 Feb. 8, 2018

(30) Foreign Application Priority Data

Aug. 4, 2016 (FR) ..... 16 57574

(51) Int. Cl.

| | |
|---|---|
| ***H01H 3/00*** | (2006.01) |
| ***H01H 50/18*** | (2006.01) |
| ***H01H 50/02*** | (2006.01) |
| ***H01H 50/36*** | (2006.01) |
| ***H01F 7/08*** | (2006.01) |

(Continued)

(52) U.S. Cl.

CPC ..... *H01H 50/18* (2013.01); *H01F 7/081* (2013.01); *H01F 7/1638* (2013.01); *H01H 50/02* (2013.01); *H01H 50/20* (2013.01); *H01H 50/36* (2013.01); *H01F 2007/086* (2013.01); *H01H 50/163* (2013.01)

(58) Field of Classification Search

CPC ..... H01H 50/18; H01H 50/02; H01H 50/36; H01H 3/28; H01H 51/22

USPC ..... 335/185

See application file for complete search history.

(56) References Cited

U.S. PATENT DOCUMENTS

| | | | |
|---|---|---|---|
| 2,539,547 | A | 1/1951 | Mossman et al. |
| 4,692,729 | A | 9/1987 | Koehler |

(Continued)

FOREIGN PATENT DOCUMENTS

| | | | |
|---|---|---|---|
| FR | 2 586 324 | A1 | 2/1987 |
| FR | 2 792 108 | A1 | 10/2000 |
| FR | 3 026 222 | A1 | 3/2016 |

OTHER PUBLICATIONS

French Preliminary Search Report dated Apr. 4, 2017 in French Application 16 57574 filed on Aug. 4, 2016 (with English Translation of Categories of cited documents).

*Primary Examiner* — Shawki S Ismail
*Assistant Examiner* — Lisa N Homza
(74) *Attorney, Agent, or Firm* — Oblon, McClelland, Maier & Neustadt, L.L.P.

(57) ABSTRACT

A mobile part of an electromagnetic actuator for an electric contactor. The mobile part is made up of a flat piece cut from a rolled sheet. This flat piece includes a first stage intended to face towards a fixed part of the actuator and a second stage, side-by-side with the first stage along an axis of movement of the mobile part. A solid section of the second stage, measured in a plane perpendicular to the axis of movement of the mobile part, is smaller than a solid section of the first stage.

16 Claims, 3 Drawing Sheets

Figure 1:
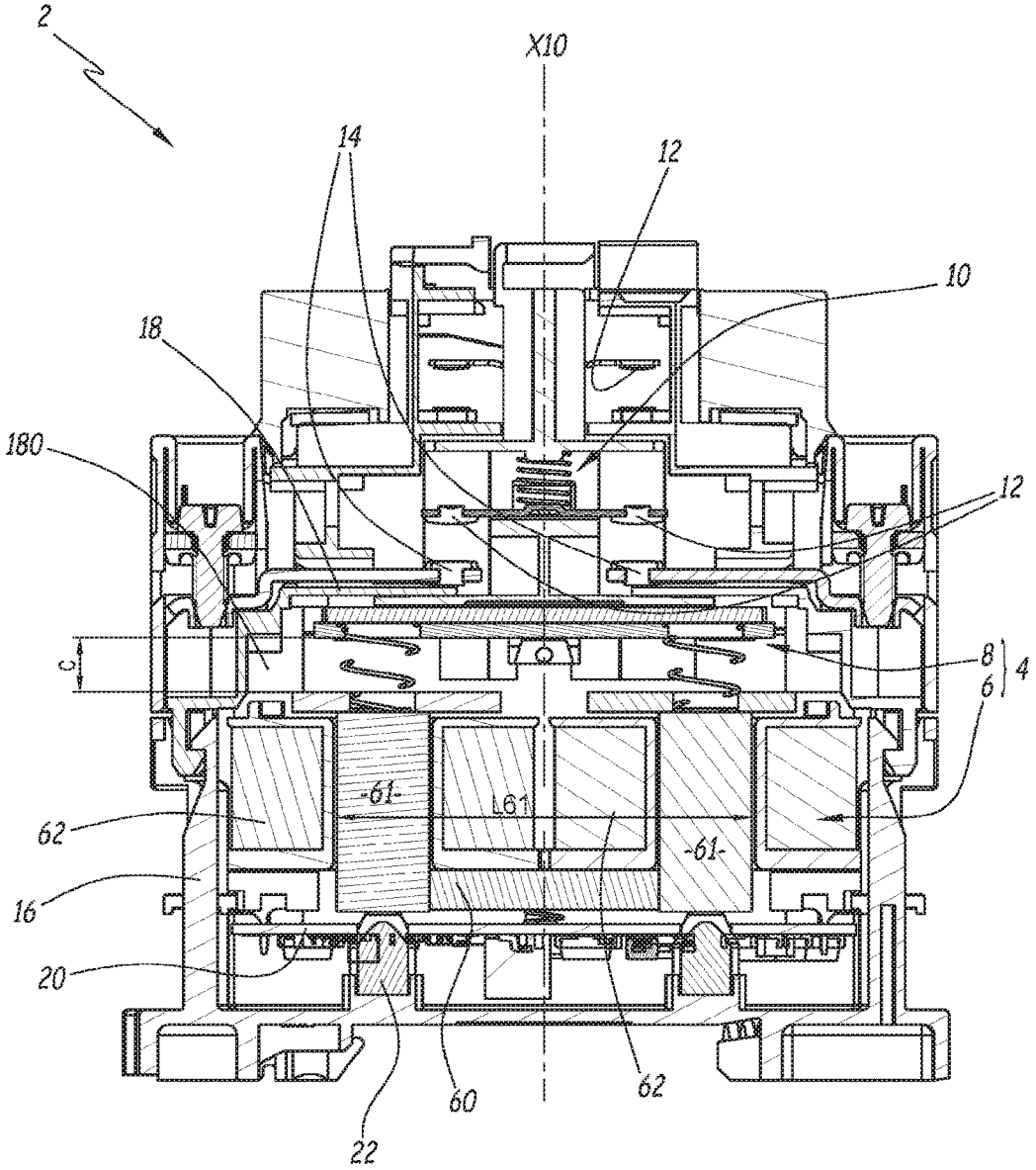

(51) Int. Cl.

| | |
|---|---|
| ***H01F 7/16*** | (2006.01) |
| ***H01H 50/20*** | (2006.01) |
| *H01H 50/16* | (2006.01) |

(56) References Cited

U.S. PATENT DOCUMENTS

| | | | | |
|---|---|---|---|---|
| 5,235,303 | A | 8/1993 | Xiao | |
| 2002/0053965 | A1 | 5/2002 | Comtois et al. | |
| 2009/0065343 | A1* | 3/2009 | Bataille | H01H 1/0015 200/502 |
| 2010/0245002 | A1* | 9/2010 | Watanabe | H01H 50/163 335/185 |
| 2011/0133975 | A1* | 6/2011 | Cartier Millon | G08C 17/00 341/176 |
| 2015/0318133 | A1* | 11/2015 | Lauraire | H01H 50/002 335/185 |
| 2015/0325397 | A1* | 11/2015 | Larcher | H01H 50/002 335/187 |
| 2017/0271095 | A1* | 9/2017 | Larcher | H01F 7/1638 |

* cited by examiner

MOBILE PART OF AN ELECTROMAGNETIC ACTUATOR FOR AN ELECTRIC CONTACTOR, ACTUATOR COMPRISING SUCH A PART AND CONTACTOR

The present invention relates to a mobile part of an electromagnetic actuator for an electric contactor.

FR-A-2 792 108 discloses an electromagnetic actuator intended to be incorporated in a direct current contactor. This actuator comprises a fixed part and a mobile part. The fixed part comprises a coil, which is arranged on an insulating yoke frame and which generates a magnetic field when it is supplied with current. The mobile part is designed to move translationally under the effect of the magnetic field generated by the coil. It comprises a magnetic core of generally cylindrical form and keepers in the form of pallets. The pallets are arranged at two ends of the core and are secured thereto. A contact-holder is translationally linked with the mobile part. The contacts of this contact-holder are connected with fixed contacts of the contactor upon the movement of the mobile part, which has the effect of closing the circuit of the contactor. One or more springs make it possible to return the mobile part to the open position when the coil is no longer supplied with current.

A first drawback with this actuator is that the mobile part is heavy because it comprises a core and two pallets. The opening and closing time is therefore relatively long. Furthermore, the mobile part comprises a lot of copper, such that this actuator is relatively expensive to manufacture.

Also, the travel of the mobile part depends on several dimensions and in particular on the distance between the two pallets. Now, this distance varies in a not-inconsiderable manner over a batch of products. Thus, a second drawback with this product is that the travel of the mobile part between its open position and its closed position is poorly controlled. The corresponding opening and closing times are therefore variable from one product to another.

It is these drawbacks that the invention more particularly sets out to remedy by proposing a mobile part of an electromagnetic actuator that is less costly to manufacture and with which the opening and closing times are better controlled.

To this end, the invention relates to a mobile part of an electromagnetic actuator for an electric contactor. According to the invention, the mobile part is made up of a flat piece, cut from a rolled sheet. The flat piece comprises a first stage intended to face towards a fixed part of the electromagnetic actuator and a second stage, side-by-side with the first stage along an axis of movement of the mobile part. A solid section of the second stage, measured in a plane perpendicular to the axis of movement of the mobile part, is smaller than a solid section of the first stage.

By virtue of the invention, the mobile part is much lighter than that of the electromagnetic actuator according to FR-A-2 792 108. The mechanical force needed to return the mobile part to the open position is thus reduced. Furthermore, less raw material is used to manufacture the mobile part. The latter therefore has a lower manufacturing cost. Moreover, the fact that the mobile part is made up of a flat piece, cut from a rolled sheet, makes it possible to obtain reduced tolerance margins with respect to the thickness of the flat piece. The amplitude of the travel of the mobile part between the open position and the closed position is therefore better controlled. Upon the closing of the contactor, the peripheral parts of the flat piece are passed through by the magnetic flux at the start of movement (increased pulling surface). The level of induction of this area remains low (less than 1 Tesla). The more the gap (the distance between the fixed part and the mobile part) decreases, the more the field lines are channelled towards the centre of the pallet. The strong inductions are concentrated in the centre of the pallet. The outside of the pallet is very slightly stressed. Thus, there is no need to have as much thickness on the edges of the flat piece as at the centre. The fact that the second stage has a solid section smaller than that of the first stage makes it possible to lighten the piece at the level of at least one of its edges. The idea is to remove material which does not conduct the magnetic flux upon the closing of the contactor to lighten the flat piece to the maximum, but without affecting the closing capacities of the actuator.

According to advantageous but non-mandatory aspects of the invention, the mobile part can comprise one or more of the following features, taken in any technically admissible combination:

- The flat piece is a rectangular pallet delimiting two long edges and two short edges, whereas the second stage has a length, measured parallel to the long edges, which is smaller than the length of the first stage.
- The ratio between the solid section of the second stage and the solid section of the first stage lies between 25% and 75%.
- The two stages of the flat piece are formed by two superposed pieces of sheets.
- The flat piece comprises at least one magnetic flux concentrator.
- Each flux concentrator is a relief formed on a surface of the flat piece oriented towards a fixed part of the actuator.

The invention relates also to an electromagnetic actuator comprising a fixed part and a mobile part as described previously.

Advantageously, the fixed part comprises two cores around which coils are wound.

Advantageously, the flat piece that makes up the mobile part comprises at least one magnetic flux concentrator, each magnetic flux concentrator being arranged so as to be opposite one of the cores of the fixed part.

Advantageously, the second stage has a length at least equal to the length of the fixed part, measured at the level of the cores.

The invention relates finally to an electric contactor comprising an actuator as described above.

According to Advantageous but Non-Mandatory Aspects of the Invention, Such an Electric Contactor can Comprise One or More of the Following Features, Taken in any Technically Admissible Combination:

- The contactor comprises an arc housing and means for holding the fixed part of the actuator in contact with the arc housing, these means comprising for example at least one elastic element.
- Each elastic element extends from a baseplate of the contactor and passes through an electronic circuit board arranged between the baseplate and the fixed part of the actuator.

Figure 2:
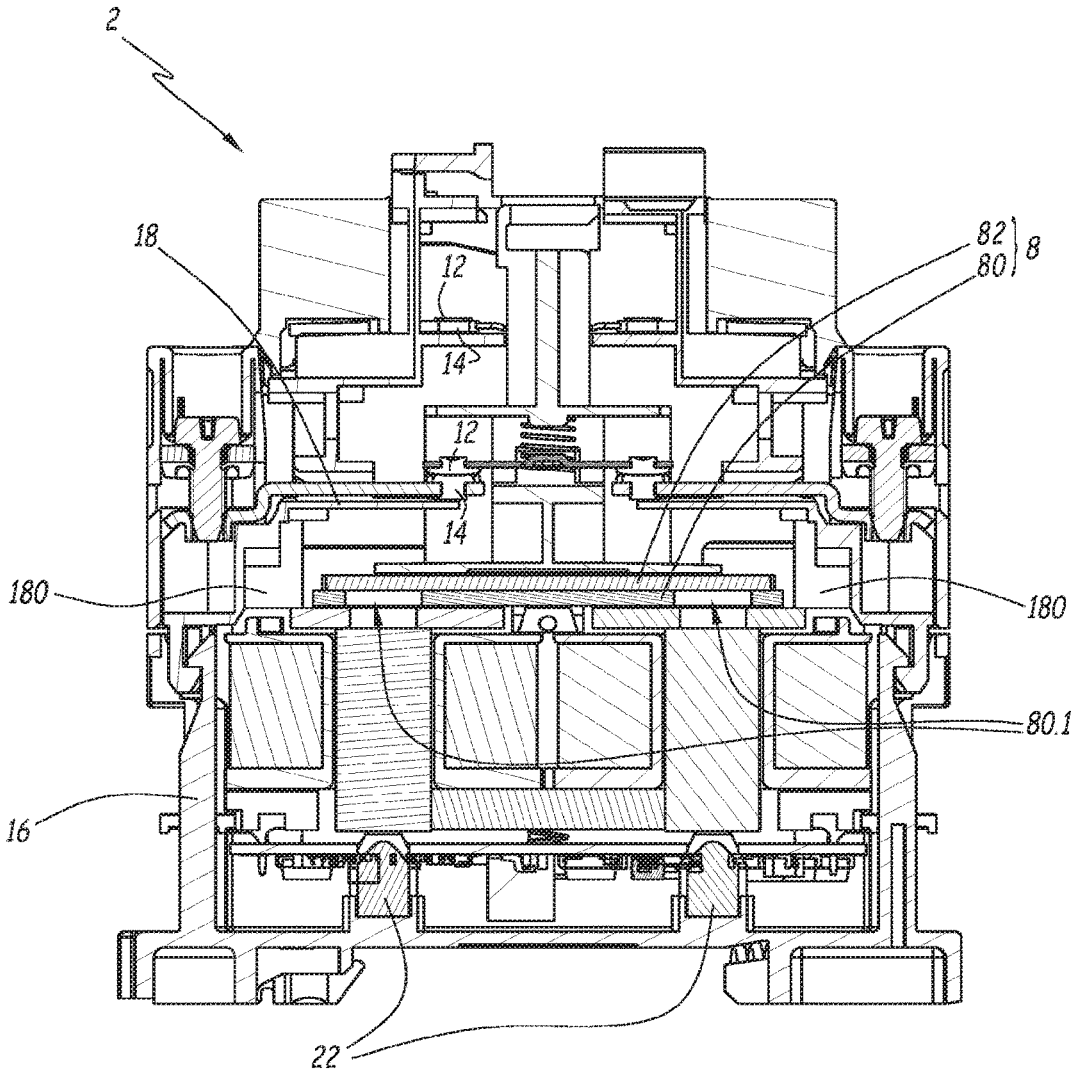
Figure 3:
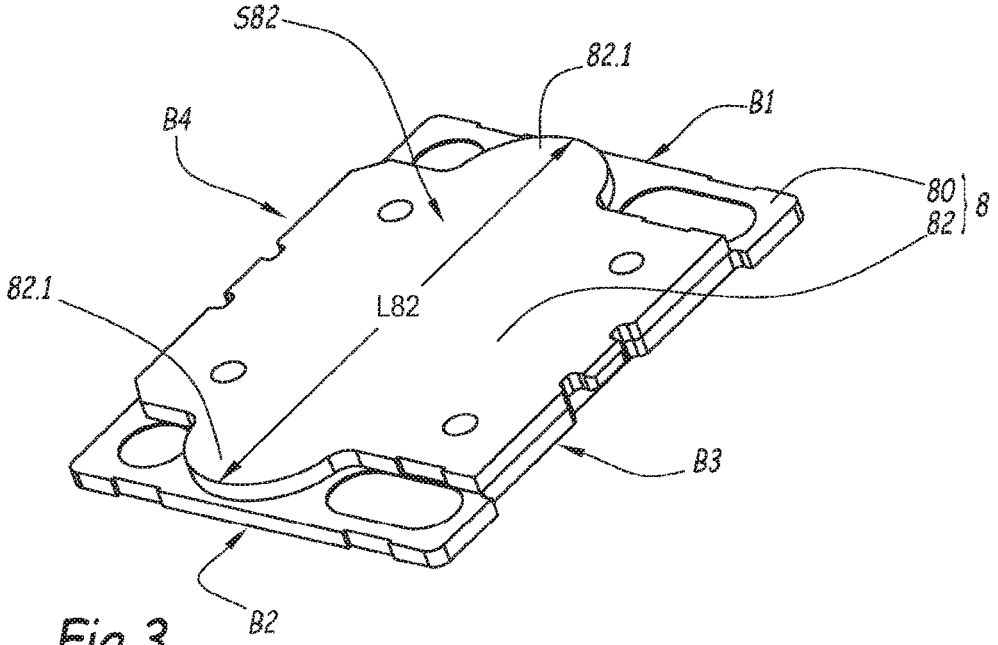
Figure 4:
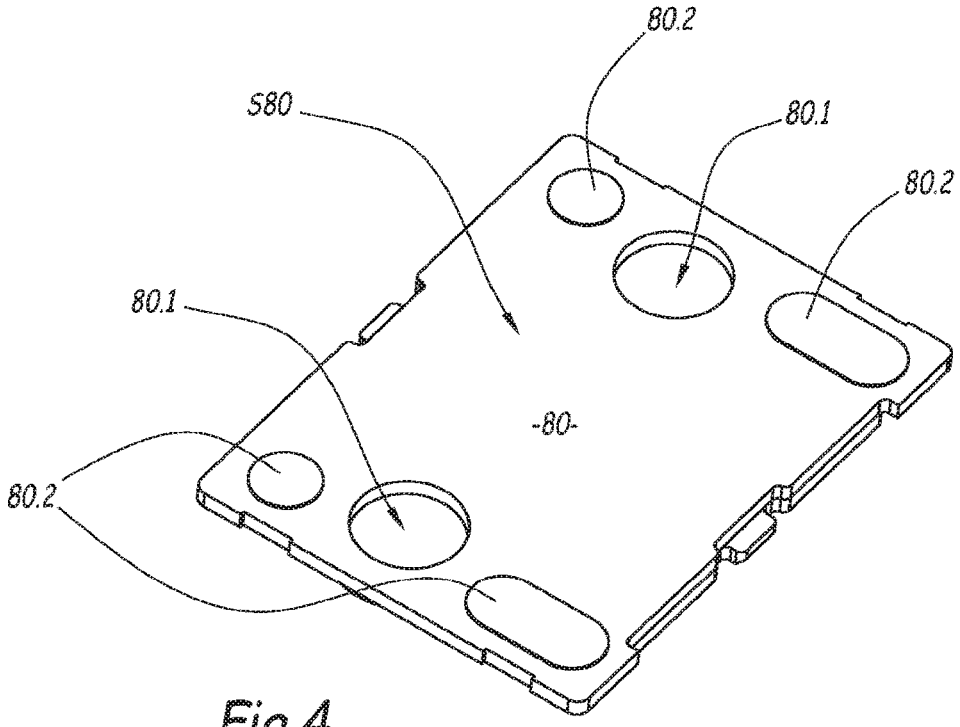

The invention and other advantages thereof will become more clearly apparent in light of the following description of an embodiment of a mobile part of an electromagnetic actuator according to its principle, given purely by way of example and with reference to the attached drawings in which:

FIG. 1 is a cross section of an electric contactor according to the invention, represented in open position and comprising an electromagnetic actuator with a fixed part and a mobile part according to the invention, FIG. 2 is a cross section similar to FIG. 1, in which the contactor is represented in closed position, and FIGS. 3 and 4 are perspective views representing a mobile part of the actuator of FIGS. 1 and 2.

FIGS. 1 and 2 show an electric contactor 2, making it possible to selectively interrupt the passage of current in a power circuit, for example between a power supply source and an electric load. In FIG. 1, the contactor 2 is represented in an open position, in which it blocks the passage of current. The contactor 2 comprises a number of mobile contacts 12 and a corresponding number of fixed contacts 14. In the example, this number is equal to two but this number can vary according to the type of unit.

The mobile contacts 12 belong to a contact-holder 10 which is mobile along an axis X10 between the open position represented in FIG. 1, in which the mobile contacts 12 and the fixed contacts 14 are separated by an insulation distance, and a closed position represented in FIG. 2, in which the mobile contacts 12 and the fixed contacts 14 are in contact and connected. The contact-holder 10 is moved translationally along the axis X10 via an electromagnetic actuator 4.

The electromagnetic actuator 4 comprises a fixed part 6 and a part 8 that is mobile along the axis X10 between the open position represented in FIG. 1 and the closed position represented in FIG. 2. The travel of the mobile part 8 is represented by the distance c in FIG. 1.

The contact-holder 10 and the mobile part 8 of the actuator 4 are linked in translation along the axis X10. In the example, the part 8 of the actuator is assembled on the contact-holder 10 so as to make it integral to the contact-holder.

The fixed part 6 comprises a keeper 60 having a U-shaped architecture. The keeper 60 therefore comprises a base and two cores 61 which extend, from the base, parallel to the axis X10. A coil 62 is wound around each of the cores 61. When they are supplied with electric current, the coils 62 generate a magnetic field which attracts the mobile part 8 of the actuator 4 towards the fixed part 6.

The electromagnetic actuator 4 comprises means for returning the mobile part 8 to the open position. In the example, these return means are formed by two helical springs 24, which extend between the fixed part 6 and the mobile part 8. The springs 24 are compression springs. For the clarity of the drawings, the springs 24 are not represented in FIG. 2.

The contactor 2 comprises a baseplate 16 and an arc housing 18 fixed to the baseplate 16. The baseplate 16 surrounds the fixed part 6 of the actuator 4. In the open position, a part of the contact-holder 10 is bearing against the arc housing 18, whereas, in the closed position, the mobile part 8 is in contact with the fixed part 6 of the actuator 4.

The contactor 2 also comprises holding means for holding the fixed part 6 of the actuator 4 in contact with the arc housing 18. More specifically, the fixed part 6 of the actuator is held in contact with lugs 180 belonging to the arc housing 18. The lugs 180 are distributed around the axis X10. In the example, there are four of them.

The abovementioned holding means comprise at least one elastic element 22, preferably two elastic elements 22. In the example, the elastic elements 22 are elastomer plugs. Each plug 22 extends from the baseplate 16 and passes through an electronic circuit board 20 via through holes formed in the board 20 for this purpose. The electronic circuit board 20 is therefore arranged between the baseplate 16 and the fixed part 6 of the actuator 4. It comprises a support made of polychlorobiphenyls (PCB).

The holding means 22 make it possible to "reference", or "polarize" the fixed part 6 of the actuator 4. This means that, over a batch of products, the fixed part 6 of the actuator 4 has the same position whatever the contactor of the batch concerned. Thus, the end point of the travel c of the mobile part 8 between the open position and the closed position is therefore well defined. That contributes to enhancing the control of the amplitude of the travel c of the mobile part 8 between the open position and the closed position and therefore, consequently, to enhancing the control of violent pressures of contacts as well as a repeatability of the opening and closing times.

As can be seen in FIGS. 3 and 4, the mobile part 8 of the electromagnetic actuator 4 is made up of a flat piece, of sheet. The expression flat piece should be understood to mean that it is a piece obtained from a rolled sheet.

The mobile part 8 in the form of the flat piece is staged: it comprises a first stage 80 intended to face towards the fixed part 6 of the electromagnetic actuator 4 and a second stage 82 intended to face, on the opposite side, towards the arc housing 18. The second stage 82 is side-by-side with the first stage 80 along the axis X10. That means that the first stage 80 and the second stage 82 are perpendicular to the axis X10 and that there is no void between the first stage 80 and the second stage 82. A solid section of the second stage 82, measured in a plane perpendicular to the axis of movement X10 of the mobile part 8, is smaller than a solid section of the first stage 80. The solid section is the area delimited by the outlines in the section plane. Thus, any holes in the first stage 80 or the second stage 82 are not taken into consideration in calculating the area. The ratio between the solid section of the second stage 82 and the solid section of the first stage 80 is dimensioned by simulation as a function of the flux that is to pass and of the ferromagnetic material used. It lies between 25% and 75%, preferably is equal to 50%.

In the example, the mobile part 8 in the form of the flat piece comprises only two stages. As a variant not represented, the flat piece can comprise a number of stages strictly greater than two. A stage corresponds to a part of the mobile part 8 in the form of the flat piece having a solid section different from at least one other part of the flat piece.

The first stage 80 delimits a surface S80 intended to be oriented towards the fixed part 6 of the electromagnetic actuator 4. In the example, the surface S80 is intended to come into contact with the fixed part 6 of the actuator 4. However, as a variant, a piece could be inserted between the parts 6 and 8 in the closed position. The second stage 82 delimits a surface S82 opposite the surface S80. The surface S82 faces towards the arc housing 18 of the contactor 2 in the assembled configuration. The surfaces S80 and S82 are substantially planar.

The second stage 82 is arranged substantially centrally. In other words, the second stage 82 covers only a central part of the first stage 80, which makes it possible to retain a sufficient passage section at the center of the pallet. On the other hand, at least one of the edges of the mobile part 8 in the form of the flat piece is delimited exclusively by the first stage 80 and has a thickness smaller than a maximum thickness of the piece.

The thickness of the mobile part 8 in the form of the flat piece is not therefore uniform. In the example, the saving in terms of weight compared to a pallet with a uniform thickness is of the order of 15%. That has no, or virtually no, effect on the magnetic performance levels because, upon the closing of the contactor 2, most of the magnetic flux generated by the coils 62 passes through the central part of the mobile part 8 in the form of the flat piece. The level of induction on the edges of the mobile part 8 in the form of the flat piece is not therefore very high. The thickness of the edges can therefore be reduced without in any way provoking magnetic saturation able to modify the magnetic behavior of the mobile part 8 in the form of the flat piece upon closing. In other words, only the material which conducts the magnetic flux not at all or very little upon the closing of the contactor is removed. That makes it possible to obtain a lightened mobile part.

Advantageously, the mobile part 8 in the form of the flat piece is a rectangular pallet comprising two small sides and two large sides. The two small sides form two opposite edges B1 and B2 of the mobile part 8 in the form of the mobile pallet. The two large sides form two opposite edges B3 and B4. The edges B1 and B2 have a reduced thickness relative to a central area of the mobile part 8 in the form of the mobile pallet where the thickness is maximum. The edges B1 and B2 are delimited exclusively by the first stage 80 of the mobile part 8 in the form of the mobile pallet, whereas the edges B3 and B4 are delimited jointly by the two stages 80 and 82. The surface S80 has a length, measured parallel to the long edges B3 and B4, which is greater than the length of the surface S82.

By virtue of the lightening of material, the opening time of the contactor 2 is shorter than when a non-lightened mobile part is used. Moreover, the closing time is substantially identical since the magnetic behavior of the lightened mobile part 8 in the form of the mobile pallet is affected not at all or very little.

In the example, the thickness of the first stage 80 is identical to the thickness of the second stage 82. The thickness of the edges B1 and B2 is therefore equal to half the maximum thickness of the mobile part 8 in the form of the flat piece. More generally, the thickness of the first stage 80 has to be dimensioned as a function of the saturation admissible in the edges relative to the maximum thickness of the mobile part 8 in the form of the mobile pallet. In practice, the thickness of the first stage 80 lies between 25% and 75% of the maximum thickness of the mobile part 8 in the form of the mobile pallet, notably between 35% and 55%.

Advantageously, the two stages of the mobile part 8 in the form of the flat piece are formed by two superposed pieces of sheets 80 and 82. The piece of sheet 82 is shorter than the piece of sheet 80, the length being measured parallel to the large sides B3 and B4 of the mobile part 8 in the form of the mobile pallet. In the example, the two pieces of sheet 80 and 82 are welded to one another, notably using a laser welding method.

Advantageously, the second stage 82 has a length L82 at least equal to the length L61 of the fixed part 6, this length being measured at the level of the cores 61. The lengths L82 and L61 are measured in a direction perpendicular to the axis X10 and contained in the plane of FIG. 1. Thus, the second stage 82 comprises parts which are axially opposite the cores 61 of the fixed part 6.

In assembled configuration in the electric contactor, the piece of sheet 80 is oriented on the side of the fixed part 6 of the actuator 4, whereas the piece of sheet 82 is oriented on the side of the arc housing 18, that is to say on the side opposite the fixed part 6 of the actuator 4.

Advantageously, the mobile part 8 in the form of the flat piece comprises at least one magnetic flux concentrator, preferably at least three magnetic flux concentrators.

In the example, the mobile part 8 in the form of the flat piece comprises four magnetic flux concentrators. These four flux concentrators are arranged at the four corners of the mobile part 8 in the form of the mobile pallet.

Each flux concentrator is a relief 80.2 formed on a face S80 of the mobile part 8 in the form of the mobile pallet oriented towards the fixed part 6 of the actuator 4. The reliefs 80.2 form surfaces of bearing of the mobile part 8 on the fixed part 6. Advantageously, each relief 80.2 is formed by sheet die-stamping. The reliefs 80.2 arranged on the side of the edge B3 are of oblong and round form: they extend parallel to the edges B1 and B2 of the mobile part 8 in the form of the mobile pallet. The reliefs 80.2 arranged on the side of the edge B4 are of circular form.

The reliefs 80.2 channel the magnetic flux generated by the coils 62. In effect, approximately 95% of the magnetic flux passes through the reliefs 80.2. That makes it possible, on the one hand, to optimize the magnetic force which holds the mobile part 8 in the closed position and thus limit the consumption of the coils 62 and, on the other hand, to potentially limit the remanant effects, that is to say the capacity of the mobile part 8 in the form of the mobile pallet to retain its magnetization.

Advantageously, each magnetic flux concentrator 80.2 is arranged so as to be axially opposite one of the cores 61 of the fixed part 6. That favours the passage of the magnetic flux through the flux concentrators 80.2.

As a variant not represented, an effect of the same type can be obtained by using a piece made of amagnetic material inserted between the fixed and mobile parts, respectively 6 and 8, of the actuator 4.

The piece of sheet 80 delimits two through holes 80.1 for the passage of an end of the return springs 24. The springs 24 bear against lugs 82.1 of the second piece of sheet 82, which is arranged above the piece of sheet 80.

According to another variant not represented, the first stage 80 and the second stage 82 are of a single piece. The mobile part of the actuator is then made up of a single-piece flat piece.

According to another variant not represented, the first stage 80 and the second stage 82 can be of different forms. For example, the first stage 80 can be formed by a square piece of sheet, whereas the second stage 82 can be a disk whose outline is inscribed inside the square delimited by the first stage. According to another example, the first stage 80 and the second stage 82 can be two disks superposed concentrically, the disk that makes up the first stage 80 then having a greater diameter than that of the disk that makes up the second stage 82.

The mobile part 8 in the form of the mobile rectangular pallet is manufactured as follows. The two pieces of sheet 80 and 82 are cut separately from rolled sheet. The piece of sheet 80 is then die-stamped to form the reliefs 80.2 and pierced to form the holes 80.1. The two pieces of sheet 80 and 82 are then welded to one another, for example by using a laser welding method. Advantageously, the weld beads are produced at the orifices 80.1 and over a part of the edge B3.

As a variant, an electric spot welding method can also be used to join the two pieces of sheet 80 and 82. In this case, the weld spots are formed at reliefs arranged on the face of the piece of sheet 82 which is in contact with the piece of sheet 80. Four weld spots are then sufficient.

The two pieces of sheet 80 and 82 can also be bonded, riveted or screwed together.

The features of the embodiment and of the variants envisaged above can be combined with one another to generate new embodiments of the invention.

The invention claimed is:

1. An electromagnetic actuator for an electric contactor, comprising:

a fixed part; and a mobile part, wherein:

the mobile part is made up of a flat piece, cut from a rolled sheet, the mobile part in the form of the flat piece includes:

a first stage intended to face towards a fixed part of the actuator, and a second stage, side-by-side with the first stage along an axis of movement of the mobile part, a solid section of the second stage, measured in a plane perpendicular to the axis of movement of the mobile part, is smaller than a solid section of the first stage, the fixed part includes two cores around which coils are wound, and the mobile part in the form of the flat piece includes at least one magnetic flux concentrator, and each magnetic flux concentrator is arranged so as to be opposite one of the cores of the fixed part.

2. The actuator according to claim 1, wherein:

the mobile part in the form of the flat piece is a rectangular pallet delimiting two long edges and two short edges, and the second stage has a length, measured parallel to the long edges, which is smaller than a length of the first stage.

3. The actuator according to claim 1, wherein a ratio between the solid section of the second stage and the solid section of the first stage lies between 25% and 75%.

4. The actuator according to claim 1, wherein the first stage and the second stage of the mobile part in the form of the flat piece are formed by two superposed sheets.

5. The actuator according to claim 1, wherein each magnetic flux concentrator is a relief formed on a surface of the mobile part in the form of the flat piece oriented towards the fixed part of the electromagnetic actuator.

6. The actuator according to claim 1, wherein:

the first stage has the two long edges and two short edges, the one-piece second stage has the two long edges and two short edges, portions of the two long edges of the first stage are aligned and flush with portions of the two long edges of the one-piece second stage, and no portion of the two short edges of the first stage are aligned and flush with any portion of the two short edges of the one-piece second stage.

7. The actuator according to claim 1, wherein the second stage is formed as a one-piece second stage.

8. An electromagnetic actuator comprising:

a fixed part; and a mobile part, the mobile part being made up of a flat piece, cut from a rolled sheet, wherein the mobile part in the form of the flat piece includes:

a first stage facing towards the fixed part, and a second stage, side-by-side with the first stage along an axis of movement of the mobile part, wherein the mobile part further includes a solid section of the second stage, that, measured in a plane perpendicular to the axis of movement of the mobile part, is smaller than a solid section of the first stage, wherein the fixed part includes two cores around which coils are wound, and wherein the mobile part in the form of the flat piece includes at least one magnetic flux concentrator, and each magnetic flux concentrator is arranged so as to be opposite one of the cores of the fixed part.

9. The actuator according to claim 8, wherein the second stage has a length at least equal to a length of the fixed part, measured at a level of the cores.

10. An electric contactor comprising an actuator according to claim 9.

11. The electric contactor according to claim 10, comprising:

an arc housing; and means for holding the fixed part of the actuator in contact with the arc housing, said means for holding including at least one elastic element.

12. The contactor according to claim 11, wherein each elastic element extends from a baseplate of the contactor and passes through an electronic circuit board arranged between the baseplate and the fixed part of the actuator.

13. An electromagnetic actuator comprising:

a fixed part; and a mobile part, the mobile part being made up of a flat piece, cut from a rolled sheet, wherein the mobile part in the form of the flat piece includes:

a first stage facing towards the fixed part, and a second stage, side-by-side with the first stage along an axis of movement of the mobile part, wherein the mobile part further includes a solid section of the second stage, that, measured in a plane perpendicular to the axis of movement of the mobile part, is smaller than a solid section of the first stage, wherein the fixed part includes two cores around which coils are wound, and wherein the second stage has a length at least equal to a length of the fixed part, measured at a level of the cores.

14. An electric contactor comprising an actuator according to claim 13.

15. The electric contactor according to claim 14, comprising: an arc housing; and means for holding the fixed part of the actuator in contact with the arc housing, said means for holding including at least one elastic element.

16. The contactor according to claim 15, wherein each elastic element extends from a baseplate of the contactor and passes through an electronic circuit board arranged between the baseplate and the fixed part of the actuator.

* * * * *